US006120713A

United States Patent [19]

Cuisin et al.

[11] Patent Number: 6,120,713

[45] Date of Patent: Sep. 19, 2000

[54] METHOD OF MAKING A CASTING MOULD HAVING A CELLULAR STRUCTURE

[75] Inventors: Thierry André Cuisin, Asnieres; Vincent Raymond Jacques Poirier, Cergy, both of France

[73] Assignee: Societe Nationale d'Etude et de Construction de Moteurs d'Aviation S.N.E.C.M.A., Paris, France

[21] Appl. No.: 08/403,946

[22] Filed: Mar. 14, 1995

Related U.S. Application Data

[62] Division of application No. 07/758,125, Sep. 12, 1991, abandoned.

[30] Foreign Application Priority Data

Sep. 12, 1990 [FR] France ..... 9011256

[51] Int. Cl.[7] ..... B29C 65/00

[52] U.S. Cl. ..... 264/43; 264/635; 264/636; 264/221

[58] Field of Search ..... 264/42, 43, 59, 264/63, 645, 670, 635, 636, 220, 221

[56] References Cited

U.S. PATENT DOCUMENTS

| | | | |
|---|---|---|---|
| 4,158,685 | 6/1979 | Masaryk | 264/43 |
| 4,356,271 | 10/1982 | Francis et al. | 501/84 |
| 4,575,439 | 3/1986 | Hintzen et al. | 264/43 |
| 4,844,148 | 7/1989 | Cuisin et al. | 164/519 |
| 5,422,055 | 6/1995 | Yalvac et al. | 264/86 |

*Primary Examiner*—Christopher A. Fiorilla
*Attorney, Agent, or Firm*—Oblon, Spivak, McClelland, Maier & Neustadt, P.C.

[57] ABSTRACT

A method of making a ceramic casting mould contains forming a contact layer on a disposable wax-type pattern of the article to be cast, placing the pattern in a preparation mould for defining the outer shape of the casting mould and filling the cavity formed between the pattern and the preparation mould with a ceramic slip which expands to form a coherent cellular foam adhering to the surface of the pattern, removing the pattern and adhered foam from the preparation mould after from 5 to 30 minutes, eliminating the pattern to leave a casting mould formed by the contact layer and the adhered foam, and then firing the casting mould to strengthen said mould. Ceramic slip compositions are also described.

10 Claims, 1 Drawing Sheet

METHOD OF MAKING A CASTING MOULD HAVING A CELLULAR STRUCTURE

This is a Division of application Ser. No. 07/758,125 filed on Sep. 12, 1991, now abandoned.

BACKGROUND OF THE INVENTION

1. Field of the Invention

The present invention relates generally to ceramic moulds for casting articles in casting processes of the lost pattern type. In particular the invention relates to a method of making such moulds and to ceramic slips for use in the method.

2. Summary of the Prior Art

As is already known, lost wax pattern casting processes using a ceramic mould comprise the following steps:

making a pattern, generally of wax, of the article to be produced;

forming a shell mould around the pattern by applying successive coatings to the pattern from a slip of specific composition and drying each coating before application of the next;

heat treating or firing the shell mould following specific temperature and time cycles so as to obtain a strengthening or "baking" of the mould and the elimination of the pattern;

casting the article in the mould thus obtained, which may be in the form of a "cluster" mould for the simultaneous casting of several articles, particularly when casting articles such as engine blades for aeronautical applications, a field with which the invention is particularly concerned; and, disposal of the shell mould.

Examples of slip compositions used for the manufacture of shell moulds for casting have been described in particular in EP-A-0 251 847; U.S. Pat. No. 3,249,927, and FR-A-2 348 772.

Also known from FR-A-2 479 044 is a casting process using a fusible pattern obtained at least partly from a foaming composition of polyurethane foam or epoxy foam type.

It is an object of the invention to provide an alternative method for the manufacture of ceramic moulds intended for lost pattern casting applications, so that the moulds obtained meet the various conditions of use generally sought in this field, making it possible to obtain cast articles meeting strict quality standards, particularly for aeronautical applications such as super-alloy components for aero-engines.

A further object of the invention is to provide a method of making the said moulds in which handling is simplified and the risk of rejects during manufacture is reduced, while also saving time in the manufacturing process.

SUMMARY OF THE INVENTION

According to the invention, there is provided a method of making a ceramic mould for the casting of an article, comprising the following steps:

(a) providing a wax-type pattern of the article to be cast;

(b) forming a contact layer on said pattern in a known manner;

(c) providing a preparation mould for defining the outer shape of the casting mould which is to be made;

(d) placing the pattern having the contact layer thereon in said preparation mould to define a cavity between said pattern and said preparation mould;

(e) introducing into said cavity a ceramic slip having a composition such that it expands to form a coherent cellular foam which fills said cavity and adheres to the contact layer of said pattern;

(f) removing the pattern and adhered foam from the preparation mould after from 5 to 30 minutes;

(g) eliminating the wax-type pattern to leave a casting mould formed by the contact layer and adhered ceramic foam; and (h) firing said casting mould to strengthen said mould by sintering.

In a first embodiment of the invention, the ceramic slip used in step (e) may consist of:

from 30 to 40% of a binder such as sodium silicate or phosphoric acid;

from 40 to 50% of a refractory ceramic charge containing materials which are known per se, such as zirconium, alumina, mullite, or mixtures thereof;

from 5 to 10% of a product which, in the presence of a catalyst, reacts to cause a release of gas, said product preferably being selected from the group consisting of perborates and peroxides;

from 3 to 4% catalyst, for example polyoxymethylene; and from 2 to 3% of adjuvants, such as cohesion agents or deflocculents which are known per se.

In a second embodiment of the invention, the ceramic slip may consist of:

from 40 to 60% of a refractory ceramic charge containing materials which are known per se, such as zirconium, alumina, mullite or mixtures thereof;

from 2 to 3% of one or more known cohesion agents; and, two silicone-based products, each present in a proportion of from 20 to 30%, which mix to form a coherent foam by gas release and reticulation of the silicone polymers.

DESCRIPTION OF THE PREFERRED EMBODIMENTS

EXAMPLE 1

The making of a ceramic mould for the casting of an article in a lost pattern casting process comprises a first stage in which a wax pattern of the article is coated, in a manner known per se, with a contact layer, for example by immersion in a slip comprising a suspension of ceramics together with various binding agents and adjuvants, followed by drying and deposition of ceramic grains by sprinkling.

Figure 1:
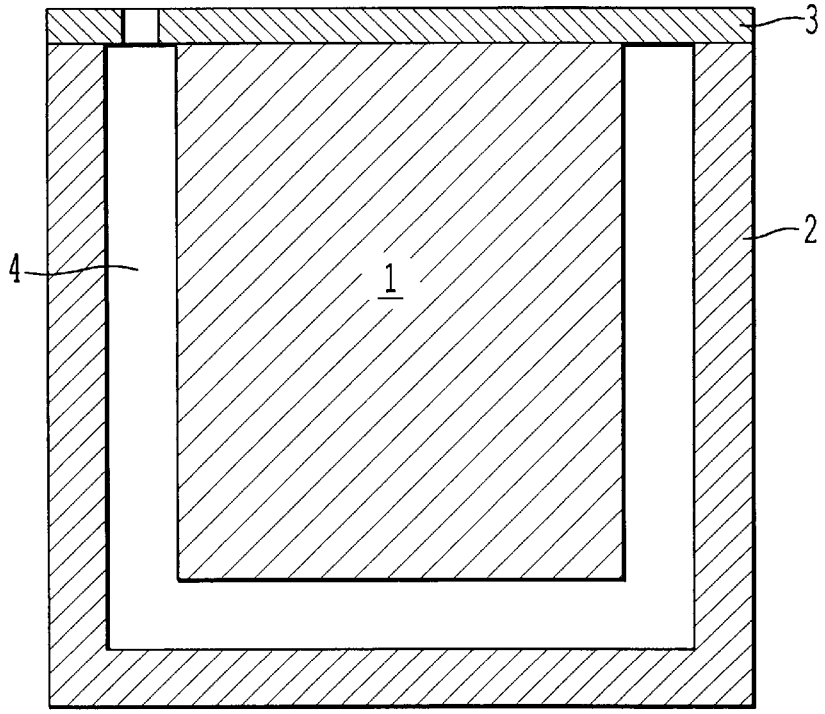
FIG. 1 is a diagrammatic cross-sectional view of an assembly at one stage in the method of making a casting mould in accordance with the invention.

In the following stage, shown diagrammatically in FIG. 1, the pattern 1 thus coated is fixed to a support 3 and placed in a preparation mould 2 which defines internally the shape of the outer surface of the casting mould which is to be produced. The preparation mould 2 is made of a material which is suitable for the purpose, e.g. silastene or other suitable plastics material, or a composite or metallic material.

At the next stage a ceramic slip of special composition in accordance with the invention is prepared, the slip consisting of:

from 30 to 40% of a binding agent, preferably sodium silicate or phosphoric acid;

from 40 to 50% of a refractory ceramic charge composed of zirconium, alumina or mullite, or mixtures thereof;

from 5 to 10% of a product which, in the presence of a catalyst, reacts to cause a considerable release of gas, said product being a perborate such as sodium perborate, or a peroxide such as hydrogen peroxide;

from 3 to 4% of polyoxymethylene as the catalyst; and from 2 to 3% of known cohesion agents and deflocculents.

Figure 2:
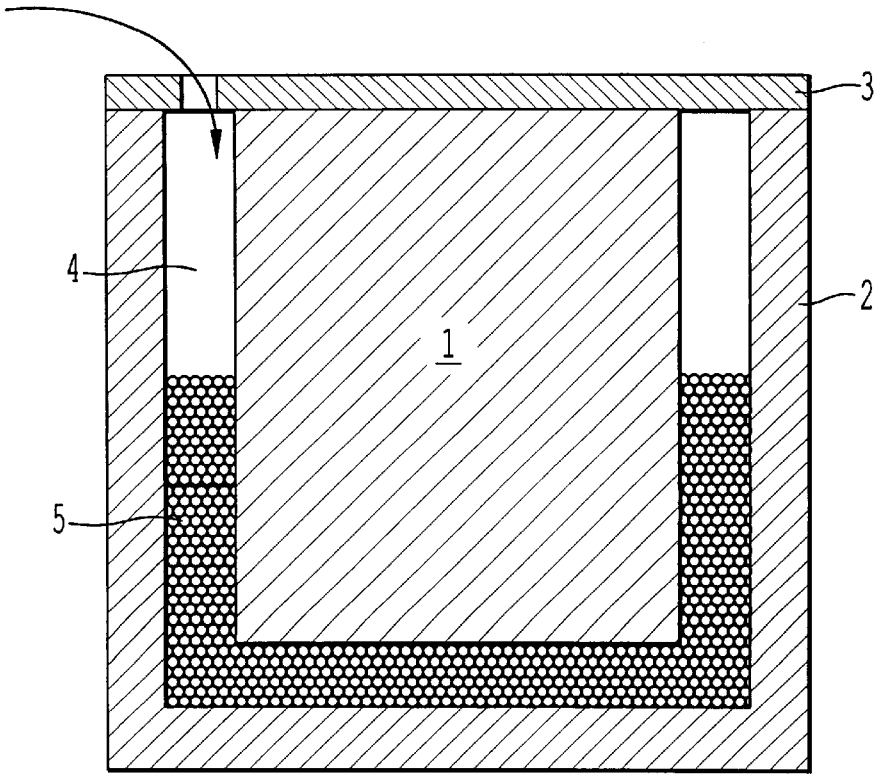
FIG. 2 is a view similar to FIG. 1 but showing the assembly at a subsequent stage of the method.

The constitutents are mixed together, and the slip obtained is introduced into the cavity 4 formed between the outside of the coated pattern 1 and the inside of the preparation mould 2, either by injection or by pouring. The gas release reaction produces a foam which expands around the pattern 1 such as shown at 5 in FIG. 2. The reaction is exothermic, which brings about rapid gelling of the binder and hence the setting of the cellular foam structure which fills the cavity 4 and adheres to the contact layer coating the pattern 1. Precise dosage of the various constitutents of the reaction enables the expansion of the foam to be controlled.

After from 5 to 15 minutes the raw, hardened ceramic shell which will form the casting mould is removed from the preparation mould 2, and the subsequent stages of the process, comprising removal of the wax pattern and firing of the shell mould to achieve strengthening by sintering, are performed in a conventional manner. It will be noted, however, that these operations are simplified as no previous wrapping is required.

The casting moulds obtained have given complete satisfaction in their applications in precision casting. The cellular structure of the mould formed in accordance with the invention enables, in particular, the refractory nature of the shell and its heat exchanges with the outside to be controlled. Furthermore, the casting mould does not exhibit any fragility during its manufacture and retains significant properties of resistance and stability.

EXAMPLE 2

In this example of the method in accordance with the invention, the steps of the method are the same as described in Example 1, with the exception of the preparation of the ceramic slip. In the present example, two silicone-based products are used, the mixing of which forms a coherent foam through gas release and reticulation of the silicone polymers.

The ceramic slip is made from an initial mixture composed of:

from 20 to 30% of one of the silicone-based products;

from 40 to 60% of a refractory ceramic charge comprising zirconium, alumina, mullite, or mixtures thereof; and from 2 to 3% of known cohesion agents.

The second silicone-based product is then incorporated into this mixture in the same proportion as the first, i.e. from 20 to 30%, to complete the slip. The slip obtained is then introduced, as in Example 1, into the cavity 4 formed between the coated pattern 1 and the preparation mould 2, either by injection or by pouring. The foam forms after a few minutes and expands around the pattern 1, adhering to the contact layer thereon. After from 15 to 30 minutes the set foam shell is taken out of the preparation mould and treated to remove the wax pattern. The shell mould is then fired to a temperature of at least 1000° C. As before, no previous wrapping of the shell is necessary. During the firing treatment of the casting mould, the silicone-based components of the mould are coverted into silica, a refractory ceramic material, while the cellular structure is retained.

This alternative choice of constituents for obtaining a casting mould comprising a ceramic foam of cellular structure provides the same advantages and the same product quality as in Example 1, namely:

non-fragility of the mould and the ability to permit handling in the raw state;

control of the refractory nature and heat exchanges with the outside; and stability of the mould.

What is claimed is:

1. A method of making a ceramic mould for the casting of an article, which comprises:

a) providing a wax-based pattern of the article to be cast;

b) forming a contact layer on said pattern;

c) providing a preparation mould for defining an outer shape of the casting mould to be made;

d) placing the pattern having the contact layer thereon in said preparation mould to define a cavity between said pattern and said preparation mould;

e) introducing into said cavity a ceramic slip having a composition which expands and fills said cavity and adheres to the contact layer on said pattern;

f) removing the pattern and adhered ceramic slip from the preparation mould after from about 5 to 30 minutes;

g) eliminating the wax-based pattern to leave a casting mould formed by the contact layer and adhered ceramic slip; and h) firing said casting mould to strengthen said mould by sintering.

2. The method according to claim 1, wherein said ceramic slip used in step e) consists of:

a binder, a refractory ceramic charge and a product which, in the presence of a catalyst, reacts to cause a release of gas, said product being selected from the group consisting of perborates and peroxides; polyoxymethylene as a catalyst; and one or more adjuvants.

3. The method of claim 1, wherein said binder is selected from the group consisting of sodium silicate and phosphoric acid.

4. The method of claim 1, wherein said refractory ceramic charge is selected from the group consisting of zirconium, alumina, mullite and mixtures thereof.

5. The method of claim 1, wherein said product which reacts to release gas is selected from the group consisting of sodium perborate and hydrogen peroxide.

6. The method according to claim 1, wherein said one or more adjuvants is selected from the group consisting of cohesion agents and deflocculants.

7. The method of claim 1, wherein said ceramic slip used in step e) consists of a refractory ceramic charge, a cohesion agent and two silicon-based products, which mix to form a coherent foam by gas release and reticulation of the silicone polymers.

8. The method of claim 7, wherein said refractory ceramic charge is selected from the group consisting of zirconium, alumina, mullite and mixtures thereof.

9. The method of claim 1, wherein said ceramic slip is introduced into said cavity in step e) by injection.

10. A method according claim 1, wherein said ceramic slip is poured into said cavity in step e) until said cavity is full.

* * * * *